United States Patent [19]

Simon et al.

[11] Patent Number: 5,033,234

[45] Date of Patent: Jul. 23, 1991

[54] DOOR COORDINATOR

[75] Inventors: Ira J. Simon, Long Beach; Andrew B. Campbell, San Marino, both of Calif.

[73] Assignee: Triangle Brass Manufacturing Company, Los Angeles, Calif.

[21] Appl. No.: 514,296

[22] Filed: Apr. 25, 1990

[51] Int. Cl.[5] ..... E05C 7/05

[52] U.S. Cl. ..... 49/367; 292/DIG. 21

[58] Field of Search ..... 49/366-369; 292/DIG. 21, 342; 16/82

[56] References Cited

U.S. PATENT DOCUMENTS

| | | | |
|---|---|---|---|
| Re. 29,107 | 1/1977 | Imhoff | 49/366 |
| 2,015,996 | 10/1935 | Eichacker | 49/366 |
| 2,921,332 | 1/1960 | Heron | 16/82 |
| 3,660,940 | 5/1972 | Tavano | 49/366 |
| 3,822,506 | 7/1974 | Fishbach | 49/367 |
| 3,894,356 | 7/1975 | Imhoff | 49/366 |
| 3,895,461 | 7/1975 | Maynard, Jr. et al. | 49/367 |
| 3,919,808 | 11/1975 | Simmons | 49/367 |
| 3,996,642 | 12/1976 | Atkins | 16/82 |
| 4,262,448 | 4/1981 | Flider | 49/367 |
| 4,428,153 | 1/1984 | Klinger et al. | 49/366 |
| 4,429,492 | 2/1984 | Imhoff | 49/367 |
| 4,583,324 | 4/1986 | Storz et al. | 49/367 |
| 4,653,229 | 3/1987 | Feucht et al. | 49/367 |

FOREIGN PATENT DOCUMENTS

| | | | |
|---|---|---|---|
| 582993 | 8/1933 | Fed. Rep. of Germany . | |
| 25719 | of 1906 | United Kingdom | 292/198 |
| 745993 | 3/1956 | United Kingdom | 49/367 |

OTHER PUBLICATIONS

Glynn-Johnson's Series COR Coordinator Brochure 1981.

Door Controls No. 600 Series Surface Mounted Coordinators Template.

*Primary Examiner*—Rodney M. Lindsay

*Assistant Examiner*—Jerry Redman

*Attorney, Agent, or Firm*—Lyon & Lyon

[57] ABSTRACT

A door coordinator for controlling the closing sequence of a pair of double doors having a common line of closure. The coordinator has a biased trigger which pivots and a door stop which translates toward the rear of the coordinator upon triggering. Override is provided by an override block (preferably pivotally mounted) biased into a first position which moves to a second position upon application of more than threshold override force. With the override block in the second position, the door stop is free to move in translation to the rear of the coordinator and permit closure of the door even if the trigger is not depressed. Threshold override force is adjusted by a screw which adjusts the angular position of a base plate in contact with biasing springs which bias the override block.

35 Claims, 3 Drawing Sheets

DOOR COORDINATOR

BACKGROUND OF THE INVENTION

1. Field of the Invention

This invention relates to the field of devices for coordinating the closing sequence of a pair of double doors having a common line of closure. More particularly it relates to door coordinators which have a trigger and a stop, the stop holding the active door open until the inactive door forces the trigger to retract and then the stop to retract permitting the active door to close.

2. Description of Related Art

Door coordinators of the prior art are discussed generally in, for example, U.S. Pat. No. 3,822,506 (the '506 patent) and U.S. Pat. No. 3,895,461 (the '461 patent). Door coordinators generally are mounted on the top underside of a door frame and have a trigger member and a stop member. The stop member blocks the "active" door from closing until the "inactive" door has finished closing and has triggered the trigger member. In the '506 patent, for example, the stop member 34 may (upon application of force to the stop member) rotate about pivot point 36 once trigger 40 is depressed. In the '461 patent stop member 28 may (upon application of force to the stop member) rotate about pivot point 36 upon activation of pivoting trigger 48. A feature incorporated in most door coordinators is the "override." The override is designed to prevent damage to the door, door hinges, door frame and coordinator in the event someone pushes on the active door in an attempt to close it prior to the closing of the inactive door (and triggering of the door coordinator). The stop member of a door coordinator is generally located as close to the hinges of the active door as possible. This minimizes the protrusion of the stop member necessary in order to hold the active door sufficiently open to permit the inactive door to swing by the active door and close. Consequently, a great deal of leverage can be exercised upon the wedge presented by the stop member by one intent upon closing the doors out of sequence. Although fit for their intended purposes, door coordinators of the prior art have experienced problems of excess wear, rough operation and erratic override force especially with operation of the override feature. Such erratic override force may result in broken door hinges and inoperative doors due to excessive resistance to override on the part of the door coordinator. Many prior art door coordinators employ cams and sliding surfaces (see, e.g., FIG. 3 of the '506 patent and FIGS. 1 and 2 of the '461 patent). The friction of the cams and sliding surfaces can vary with wear, lubrication and surface finish resulting in unpredictable and changing amounts of force being required to engage the oVerride feature. As a consequence, a need exists for an improved door coordinator having improved smoothness of operation, improved adjustability of the override threshold, less friction in operation and an improved override feature.

SUMMARY OF THE INVENTION

The present invention comprises a door coordinator apparatus for coordinating the closing sequence of an active and an inactive door of a pair of double doors having a common line of closure. A novel door stop mechanism is provided which utilizes translatory motion to provide smoother operation in general and especially improved override operation. The door stop mechanism is further novel in that it is directly linked via a control means to a trigger which, when activated, causes retraction of the door stop regardless of whether the door is in contact with the stop at the time. A novel override feature is provided which provides for smoother override operation, reduced friction, improved shock cushioning and finer and simpler adjustment of the override threshold than previously available.

The novel override feature includes a member which rotates from a first position to a second position permitting the door stop to roll free of the member and translate back in retraction.

Accordingly, it is an object of this invention to provide an improved door coordinator having a door stop capable of translatory motion.

It is a further object of this invention to provide an improved door coordinator having smoother operation in general and smoother override operation.

It is a further object of this invention to provide an improved door coordinator having improved override operation and finer and simpler adjustability of the override threshold.

It is a further object of this invention to provide an improved door coordinator having smoother and quieter operation which is desirable to architects and building occupants.

It is a further object of this invention to provide an improved door coordinator having reduced friction in the override mechanism.

Other and further objects and advantages of the present invention will appear hereinafter.

DETAILED DESCRIPTION OF THE PREFERRED EMBODIMENTS

In a preferred embodiment of the present invention a door coordinator for coordinating the closing sequence of a pair of double doors having a common line of closure is preferably designed for installation at the top underside of a door frame so that the "rear" face of the door may contact the coordinator controls. The coordinator controls include a trigger and a stop. The active door is kept open by the stop until the trigger is sufficiently depressed by the inactive door that it causes the stop to retract and thus cease preventing the closure of the active door. Preferably an override feature is provided to allow the active door to be forced shut out of sequence without damage to the door, the door hinges, the door coordinator, or the door frame.

Figure 1:
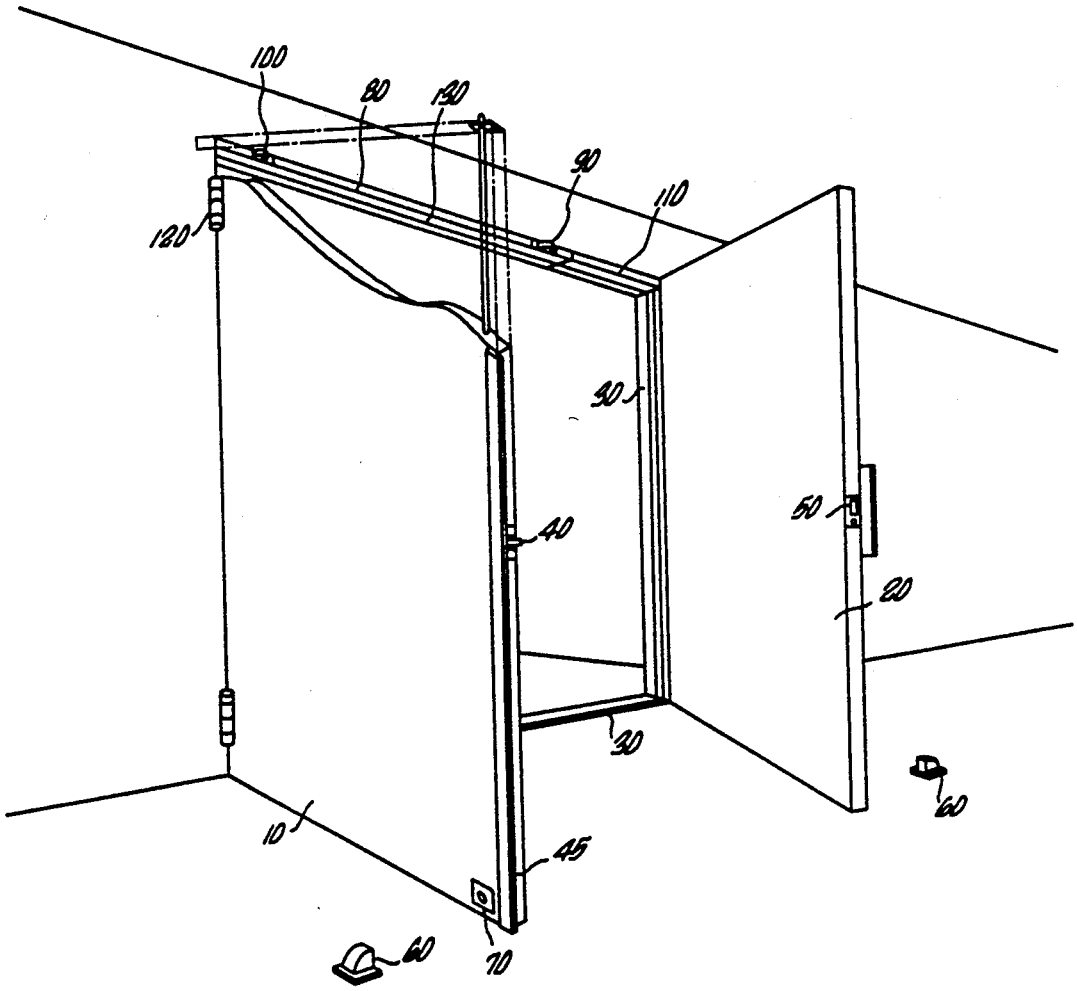
FIG. 1 is a front perspective view of a pair of doors showing the installation of the door coordinator.

Turning now to the drawings, FIG. 1 depicts a typical double door installation. Double doors 10, 20 consist of an active door 10 and inactive door 20. In a preferred embodiment of the present invention it is desirable that inactive door 20 be shut against the door frame 30 prior to the full closing of active door 10 against door frame 30. This is desired at least in part because door latch 40 of the active door 10 preferably engages door latch receptacle 50 of inactive door 20 and this may typically be accommodated automatically, as well known in the art, if inactive door 20 is shut against door frame 30 prior to the closure of active door 10. Astragal 45 is typically included in double door installations as is well known in the art and provides a further impetus for coordinating the closing of doors 10, 20.

Optionally floor mounted door stops 60 may be provided to latch double doors 10, 20 at plates 70 when it is desired that they be held open. These are well known to those of skill in the art.

The door coordinator 80 includes a trigger 90 (also "trigger member" and "trigger means" herein) for engagement with inactive door 20 and a stop 100 (also "stop member" and "stop means" herein) for engagement with active door 10. Optionally, extension housing 110 may be installed to cosmetically fill in the space between the door coordinator 80 and the edge of the door frame 30. No other functionality is provided by extension housing 110 and it may consist of, preferably, a hollow tube (or other structure consistent with the enclosure means set forth below) which may be cut to fit a particular installation. It may be attached in a conventional fashion, for example, by wood or metal screws, as appropriate, as is well known to those of skill in the art. The double doors 10, 20 are attached to door frame 30 by hinges 120 as is well known in the art.

Figure 2:
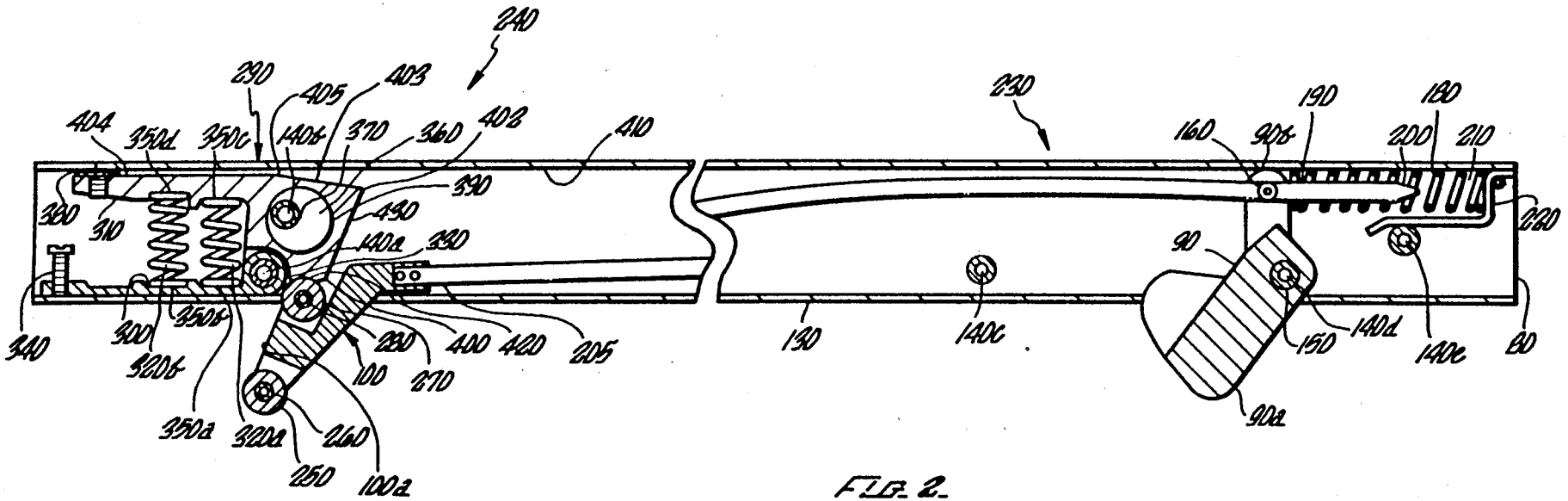
FIG. 2 is a top cross sectional view of the fully disengaged door coordinator.

Turning to FIG. 2 a cross sectional top view of door coordinator 80 is depicted. The door coordinator 80 is preferably housed in a steel tube 130 of rectangular cross section (also "enclosure means" and "mounting means" herein). Other materials, frames, housings and structures having different cross sections could be used as is known to those of skill in the art. For example, the door coordinator could be mounted on a frame of U-shaped channel, or possibly on a flat sheet of material, or integrally to the door frame itself. Mounting holes **140*a*, 140*b*, 140*c*, 140*d* and 140*e* are preferably provided for attaching door coordinator 80 to the top of the door frame 30 as depicted in FIG. 1**. Wood or metal screws or other appropriate fasteners may be used as would plainly appear to one of ordinary skill in the art.

Figure 3:
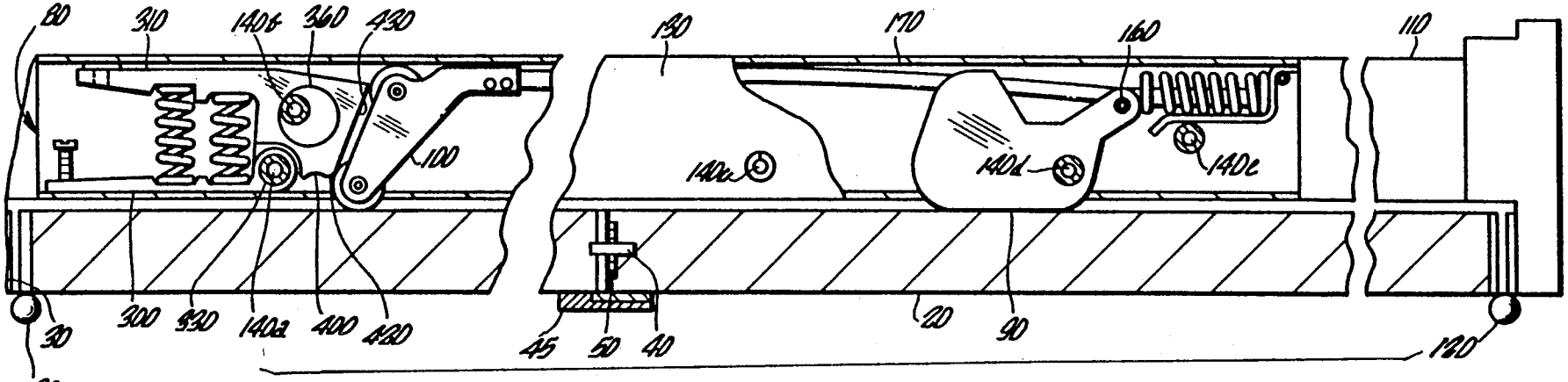
FIG. 3 is a top cross sectional view of the door coordinator showing its configuration with both doors closed.
Figure 4:
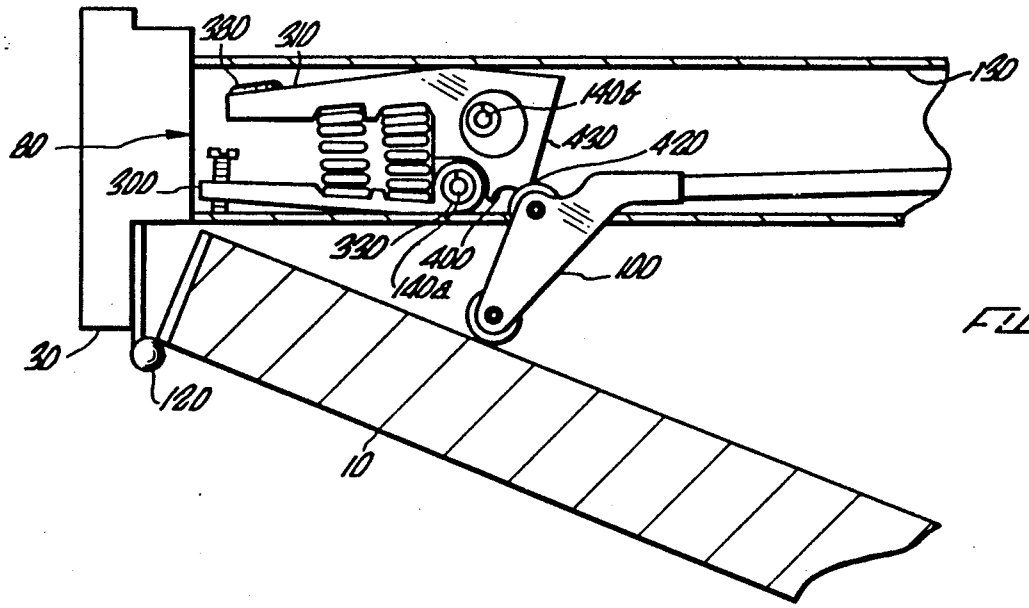
FIG. 4 is a top cross sectional view of the override feature of the door coordinator with the override feature at threshold between the first override position (which it is in) and the second override position (which it will enter if incremental force is applied to stop 100).

FIG. 2 depicts the door coordinator 80 as it would appear when it is in contact with neither of the double doors 10, 20. FIG. 3 depicts the door coordinator 80 as it would appear with both double doors 10, 20 shut. FIG. 4 depicts the door coordinator 80 at the threshold of the override condition with inactive door 20 (not shown) open, trigger 90 not engaged (i.e., in a protracted trigger position), and active door 10 almost forced to the point of closure (and override of stop 100).

For ease of reference, the "front" of the door coordinator 80 shall refer to the side which contacts the "rear" face of double doors 10, 20 and the "rear" shall refer to the opposite side. The "front" face of double doors 10, 20 is the other side from the "rear" face. The "active" side 240 of door coordinator 80 shall refer to the portion of door coordinator 80 which is depicted in the lower portion of FIG. 2 and the "inactive" side 230 of door coordinator 80 shall refer to the portion of door coordinator 80 which is depicted in the upper portion of FIG. 2.

In a preferred embodiment of the present invention, door coordinator 80 includes trigger 90 which is a pivotally mounted bell crank pivotally mounted preferably about mounting hole **140*d* preferably to tube 130 at first pivot point 150. Trigger 90 is preferably fabricated of a steel casting or laminated sheet metal stampings as are well known in the art. Trigger 90 includes a first arm 90*a* and a second arm 90*b*. First arm 90*a* engages inactive door 20 preferably at a contact plate (especially in the case of a wooden door) which is not shown and which may be fabricated of a metal or plastic material in order to retard wear on the inactive door 20 at the area of contact between the inactive door 20 and the first arm 90*a*. First arm 90*a* is preferably rounded in the region in which it makes contact with the inactive door 20 as shown in the drawings. This feature also retards wear on the inactive door 20 as well as wear on the first arm 90*a*. This feature also provides for smoother and easier operation of door coordinator 80**.

When inactive door 20 is closed against door coordinator 80 first arm **90*a* of trigger 90 is forced from a normally protracted position ("protracted trigger position") to a "retracted trigger position" with first arm 90*a* substantially retracted within the enclosure means 130**.

Second arm **90*b* extends toward the rear of door coordinator 80 from the pivot point of the trigger 150. In pinned pivotal attachment to second arm 90*b* at second pivot point 160 is control rod 170. Control rod 170 ("control means" operatively interconnecting trigger 90 and stop 100) has a first tip end 200 and a second end 205. Second arm 90*b* engages a first biasing means 180 at biasing means engagement surface 190. In a preferred embodiment first biasing means 180 is a coiled spring providing a force sufficient (in combination with the additional biasing force provided by bowed control rod 170) to return the trigger and stop to the protracted positions when neither are in contact with either door. The first tip end 200 of control rod 170 extends through coiled spring 180. A pocket 210 is preferably defined of sheet metal 220 (preferably aluminum or steel) to which and within which is mounted first biasing means 180. In a preferred embodiment, spring 180 is formed of 14 coils of 0.043"diameter stainless steel wire, has an outside diameter of 0.500"and is 3.0"long when not compressed. When the trigger 90 is fully engaged (i.e., retracted trigger position), tip 200 of control rod 170 is pushed into pocket 210 as shown in FIG. 3, but, as shown in the drawings, tip 200 does not make contact with sheet metal 220**.

Control rod 170 (preferably fabricated of mild steel) extends from the inactive side 230 of door coordinator 80 to the active side 240 of door coordinator 80. In a preferred embodiment, control rod 170 is itself biased as shown in FIG. 2. This is so because biasing spring 180 is not sufficient in the preferred embodiment to push stop 100 up ramp 430. Control rod 170 is compressed and bowed so that the center of control rod 170 is deflected approximately 0.625"off of the central linear axis of the rod. Control rod 170 is therefore a combination control rod and biasing device. In a preferred embodiment the center of bowed control rod 170 rests against inner rear wall 410 when trigger 90 is not engaged and stop 100 is protracted. Thus in this embodiment, "first biasing means" includes spring 180 and bowed rod 170. Control rod 170 is pinned at its second end 205 to stop 100 in fixed attachment. Stop 100 includes a first wheel means 250 (preferably fabricated of nylon or delrin) mounted on first axle means 260 (preferably fabricated of hardened steel) of stop 100. First wheel means 250 is free to rotate about first axle means 260. Stop 100 makes contact with active door 10 at first wheel means 250. This feature minimizes wear on active door 10 and door coordinator 80 through lowered friction provided by the rolling mechanism of first wheel means 250 and the smoother and constant override activation force operation of door coordinator 80 provided thereby. Stop 100 includes a preferably similar second wheel means 270 which is mounted on and free to rotate about a preferably similar second axle means 280.

In a preferred embodiment Stop 100 operates in conjunction with override mechanism 290. Override mechanism 290 performs the functions of (1) providing a resting place for stop 100 when trigger 90 is protracted (inactive door 20 open); (2) providing a ramp over which stop 100 may travel in translation during the closure of active door 10; and (3) providing a biased override function to allow closure of active door 10 despite the protracted position of trigger 90 upon application of sufficient closing force to active door 10 (thus preventing damage to door coordinator, door frame, hinges and door).

In "normal" non-override operation, stop 100 has a protracted position ("protracted stop position") wherein the active door is held open and a "retracted stop position" wherein the active door may close. The transverse translation (along the length of the coordinator away from the active side) of control rod 170 upon activation (retraction) of trigger 90 causes stop 100 to move away from the resting place thus resulting in rearward translation of stop 100 along "ramp" (or "sloped portion" or "ramp means") 430 of override block 310 from the protracted stop position to the retracted stop position.

Override mechanism 290 includes an override base 300, an override block 310 ("override block means"), and second biasing means 320*a*, 320*b* consisting, in a preferred embodiment, of two helical die springs with combined force to satisfactorily resist actuating the override feature, yet allowing the override feature to activate prior to the onset of damage. The solid height of the springs must be sufficiently small to allow override mechanism 290 to rotate sufficiently (at least about 9 degrees in a preferred embodiment) to allow stop 100 to slide down ramp 430 prior to springs 320*a*, 320*b* going solid (becoming fully compressed). Rectangular spring wire has been used in a preferred embodiment for springs 320*a*, 320*b* and has provided the best results.

Override base 300 (preferably fabricated of steel or brass extrusion) is pivotally mounted to tube 130 at third pivot point 330. Override base 300 includes a bias adjustment means which in a preferred embodiment consists of a threaded bias adjustment screw 340 which is used to adjust the compression of second biasing means 320*a* and 320*b* ("override biasing means"). Bias adjustment screw 340 extends through override base 300 and is capable of making contact with tube 130 so as to force override base 300 pivotally away from tube 130 as depicted in FIG. 4.

In a preferred embodiment where second bias means consists of two helical springs, indentations 350*a*, *b* are provided in override base 300 and indentations 350*c*, *d* are provided in override block 310 to provide seats for the helical springs of second biasing means 320*a*, *b*. Additional seats for additional springs may be provided as desired as a function of the override bias desired and the spring constants of the springs used as would be known to those of skill in the art.

Override block 310 (preferably fabricated of cast steel or laminated steel sheet) includes a void or "open region" 360. Override block 310 is free to move constrained only by the position of override base 300, contact of the boundary 390 of open region 360 with a metal cylinder 370 surrounding mounting hole 140*b* (metal cylinders surround all of the mounting holes 140*a*, *b*, *c*, *d* and *e* in a preferred embodiment), the position of stop 100, and tube 130. Override block 310 further preferably includes rubber rest 380 which holds a portion of override block 310 at least a fixed distance from tube 130, and reduces noise when the override feature is activated. In a preferred embodiment, override block 310 is pivotally mounted to the mounting means at pivot point 330.

Override block 310 further includes a rest portion 400 against which second wheel means 270 may rest when trigger 90 is protracted and an override condition is not present. Preferably rest portion 400 is concave and includes lip 420 to restrain movement of second wheel means 270.

Override block 310 includes a rear portion 402 which is not flat but includes two substantially flat portions 403 and 404 joined at apex 405 to form an angle of less than 180°. (In a preferred embodiment of the present invention, this angle is 171 degrees). Rubber rest 380 is adapted for contact with the inner rear wall 410 of tube 130 when the override feature is not engaged. When pressure is applied to stop 100 as by an active door 10 being forced closed, force will be transferred from active door 10 through the first wheel means 250 to first axle means 260 to the body 100*a* of stop 100 (body 100*a* is preferably fabricated of cast steel or laminated steel sheet), to the second axle means 280 to the second wheel means 270 to the rest portion 400 of override block 310 forcing apex 403 of rear portion 402 of override block 310 back toward the inner rear wall 410 of tube 130. Increased force will then cause first flat portion 403 of override block 310 to move toward inner rear wall 410 of tube 130 and second flat portion 404 of override block 310 to move away from inner rear wall 410 of tube 130 and toward the front of door coordinator 80. This action is depicted in FIG. 4. With increased active door closing force (absent retraction of trigger 90) the force vector from the active door through the stop in view of the changed angle presented by the rest portion 400 of override block 310 to second wheel means 270 will result in second wheel means 270 rolling over the lip 420 of rest potion of override block 310. (At this point, the override block 310 is in a "second override position" permitting override. Prior to this point, the override block 310 was in a "first override position" not permitting override.) Second wheel means 270, and, subsequently first wheel means 250 will then engage sloped portion 430 of override block 310 and roll in translation toward the rear of the door coordinator 80 causing retraction of stop 100 and closure of active door 10. This is the so called "override mode" or "override feature" or "override condition" wherein "normal" operation of the door coordinator 80 is overridden by pressure greater than that normally presented by the active door as when a person pushes on the active door to force it closed when the inactive door is open and trigger 90 protracted.

Second biasing means 320*a*, 320*b* together with bias adjustment screw 340 act to prevent override mode unless more than a predetermined amount of closing force (set by bias adjustment screw 340) is applied to the active door. In a typical installation, door closers (not shown) are used to impart closing bias to both the active door 10 and the inactive door 20. Upon installation the force imparted by the door closer and the bias adjustment screw 340 may be set so that override mode does not occur unless additional (more than "normal") closing force is applied to the active door. In this fashion, "normally" the inactive door will close first, causing retraction of trigger 90 and rear translation and retraction of stop 100 and thus closure of active door 10.

The rolling nature of the override feature provided herein is a significant improvement over prior art sliding override features. Prior art sliding override mechanisms result in unpredictable amounts of friction which must be overcome to engage the override. Thus the override threshold is unpredictable and changes with wear, changes in lubrication, etc. The present invention provides an override feature which is consistent in operation as set in that the force required to activate the override should remain much closer to the value set at installation than prior art door coordinators have been able to obtain.

While embodiments and applications of this invention have been shown and described, it would be apparent to those of ordinary skill in the art that many more modifications are possible without departing from the inventive concepts disclosed herein. The invention, therefore, is not to be restricted except in the spirit of the appended claims.

We claim:

1. A door coordinator for coordinating the closing sequence of an active door and an inactive door of a pair of double doors having a common line of closure comprising:

A mounting means,

A stop means having a protracted stop position and a retracted stop position,

Said stop means moveable relative to said mounting means between said protracted stop position and said retracted stop position and located for engagement with the active door, Pivotally mounted trigger means located for engagement with the inactive door having a protracted trigger position and a retracted trigger position, and Control means operatively connecting said trigger means and said stop means to control movement of said stop means and thereby control the closing sequence of the active door and the inactive door, and an override means including an override block means pivotal relative to said mounting means.

2. A door coordinator as set forth in claim 1 additionally including first biasing means biasing said trigger means toward said protracted trigger position.

3. A door coordinator as set forth in claim 1 wherein said movement of said stop means is translational movement.

4. A door coordinator as set forth in claim 1 additionally comprising:

Said override means including override biasing means and said override block means, Said override block means having a first override position and a second override position, Said override block means biased to said first override position by said override biasing means, and A predetermined amount of closing force applied to said stop means capable of placing said override block means in said second override position and causing said stop means to move to said retracted stop position.

5. A door coordinator as set forth in claim 4 wherein said movement of said stop means is translational movement and said stop means is translatable to said retracted stop position.

6. A door coordinator as set forth in claim 4 additionally including:

An override base,

Said override base mounted to said mounting means and operatively engaged with said override biasing means, and Said override base including bias adjustment means for adjusting the bias imparted to said override block means by said override biasing means.

7. A door coordinator as set forth in claim 6 wherein said override base is pivotally mounted to said mounting means.

8. The door coordinator as set forth in claim 6 wherein:

Said bias adjustment means comprises at least one element capable of protruding through said override base and capable of engaging said mounting means and capable of holding said override base away from said mounting means by a fixed displacement.

9. The door coordinator as set forth in claim 8 wherein said override base is pivotally mounted to said mounting means.

10. The door coordinator as set forth in claim 9 wherein said bias adjustment means is capable of holding said override base away from said mounting means by a fixed angular displacement.

11. A door coordinator for coordinating the closing sequence of an active door and an inactive door of a pair of double doors having a common line of closure comprising:

A mounting means,

A stop means having a protracted stop position and said a retracted stop position, Said stop means moveable relative to said mounting means between said protracted stop position and said retracted stop position and located for engagement with the active door, Trigger means located for engagement with the inactive door having a protracted trigger position and a retracted trigger position, Control means operatively connecting said trigger means and said stop means to control movement of said stop means and thereby control the closing sequence of the active door and the inactive door, first biasing means biasing said trigger means toward said protracted trigger position said first biasing means additionally biasing said stop means toward said protracted stop position, and an override means including an override block means pivotal relative to said mounting means.

12. A door coordinator for coordinating the closing sequence of an active door and an inactive door of a pair of double doors having a common line of closure comprising:

A mounting means,

A stop means located for engagement with the active door having a protracted stop position to which it is biased and a retracted stop position, A trigger means located for engagement with the inactive door having a protracted trigger position to which it is biased and a retracted trigger position, Said stop means and said trigger means operatively interconnected such that, absent an override condition, retraction of said trigger means from said protracted trigger position to said retracted trigger position causes movement of said stop means from said protracted stop position to said retracted stop position, and an override means including an override block means pivotal relative to said mounting means.

13. A door coordinator as set forth in claim 12 wherein said movement of said stop means is translational movement.

14. A door coordinator as set forth in claim 12 additionally comprising:

said override means including override biasing means and said override block means, said override block means moveable relative to said mounting means and having a first override position and a second override position, said override block means biased to said first override position by said override biasing means and having a rest portion adapted to restrain said stop means from rear translatory motion when said override block means is in said first override position.

15. A door coordinator as set forth in claim 14 wherein said rest portion is further adapted to permit rear translatory motion of said stop means upon occurrence of said override condition.

16. A door coordinator as set forth in claim 14 wherein said movement of said stop means is translational movement.

17. A door coordinator as set forth in claim 14 wherein said rest portion is further adapted to permit rear translatory motion of said stop means when said override block means is in said second override position.

18. A door coordinator as set forth in claim 17 additionally including:

An override base mounted to said mounting means and operatively engaged with said override biasing means, and override bias adjustment means.

19. A door coordinator as set forth in claim 18 wherein said trigger means is pivotally mounted to said mounting means.

20. A door coordinator as set forth in claim 18 wherein said override base is pivotally mounted to said mounting means.

21. A door coordinator as set forth in claim 18 wherein:

said override bias adjustment means comprises at least one element capable of protruding through said override base for operative engagement with said mounting means.

22. A door coordinator as set forth in claim 21 wherein said override base is pivotally mounted to said mounting means.

23. A door coordinator as set forth in claim 22 wherein said override bias adjustment means is capable of holding said override base away from said mounting means by a fixed angular displacement.

24. A door coordinator as set forth in claim 23 wherein said trigger means is pivotally mounted to said mounting means.

25. A door coordinator as set forth in claim 24 wherein said trigger means is a bell crank having a first arm for engagement with the inactive door and a second arm for operative engagement with a control means, said control means operatively interconnecting said trigger means and said stop means.

26. A door coordinator for coordinating the closing sequence of an active door and an inactive door of a pair of double doors having a common line of closure comprising:

A mounting means;

A stop means having a protracted stop position to which it is biased and a retracted stop position;

Override means including override biasing means and override block means, said override block means pivotal relative to said mounting means and having a first override position and a second override position; and said override block means biased to said first override position by said override biasing mans and having a rest portion adapted to restrain said stop means from rear translatory motion when said override block means is in said first override position.

27. A door coordinator as set forth in claim 26 wherein said rest portion is further adapted to permit rear translatory motion of said stop means when said override block means is in said second override position.

28. A door coordinator as set forth in claim 26 wherein said override block means is pivotally mounted to said mounting means.

29. A door coordinator as set forth in claim 26 additionally including:

An override base mounted to said mounting means and operatively engaged with said override biasing mans, and override bias adjustment means.

30. A door coordinator as set forth in claim 29 wherein said override base is pivotally mounted to said mounting means.

31. A door coordinator as set forth in claim 29 wherein said override bias adjustment means includes means for displacing said override base relative to said mounting means.

32. A door coordinator for coordinating the closing sequence of an active door and an inactive door of a pair of double doors having a common line of closure comprising:

Mounting means,

Stop means located for engagement with the active door and moveable between a protracted stop position and a retracted stop position, Override means including override biasing means and a pivotal override block means, Said override block means having a first override position and a second override position, Said override block means biased to said first override position by said override biasing means, and A predetermined amount of closing force applied to said stop means capable of placing said override block means in said second override position and causing said stop means to move to said retracted

33. The door coordinator as set forth in claim 32 additionally comprising:

An override base mounted to said mounting means and operatively engaged with said override biasing means, and Bias adjustment means for adjusting the bias imparted to said override block means by said override biasing means.

34. The door coordinator as set forth in claim 33 wherein said bias adjustment means comprises at least one element capable of protruding from said override base, making contact with said mounting means and holding said override base away from said mounting means by a fixed displacement.

35. The door coordinator as set forth in claim 34 wherein said override base is pivotally mounted to said mounting means.

* * * * *

UNITED STATES PATENT AND TRADEMARK OFFICE

CERTIFICATE OF CORRECTION

PATENT NO. : 5,033,234

DATED : July 23, 1991

INVENTOR(S) : IRA J. SIMON et al.

It is certified that error appears in the above-identified patent and that said Letters Patent is hereby corrected as shown below:

In claim 32 (col. 10, l. 51) after "retracted" insert -- stop position. --.

Signed and Sealed this

Twenty-seventh Day of April, 1993

*Attest:*

MICHAEL K. KIRK

*Attesting Officer*

*Acting Commissioner of Patents and Trademarks*